US008016952B2

(12) United States Patent
Ishida et al.

(10) Patent No.: US 8,016,952 B2
(45) Date of Patent: Sep. 13, 2011

(54) FERROMAGNETIC SHAPE MEMORY ALLOY AND ITS USE

(75) Inventors: Kiyohito Ishida, Sendai (JP); Katsunari Oikawa, Sendai (JP); Ryosuke Kainuma, Natori (JP); Takeshi Kanomata, Sendai (JP); Yuji Sutou, Sendai (JP)

(73) Assignee: Japan Science and Technology Agency, Saitama-ken (JP)

( * ) Notice: Subject to any disclaimer, the term of this patent is extended or adjusted under 35 U.S.C. 154(b) by 670 days.

(21) Appl. No.: 11/993,812

(22) PCT Filed: Jun. 27, 2006

(86) PCT No.: PCT/JP2006/312835

§ 371 (c)(1),
(2), (4) Date: Dec. 21, 2007

(87) PCT Pub. No.: WO2007/001009

PCT Pub. Date: Jan. 4, 2007

(65) Prior Publication Data

US 2010/0156579 A1 Jun. 24, 2010

(30) Foreign Application Priority Data

Jun. 27, 2005 (JP) ..... 2005-186663

(51) Int. Cl.
*H01F 1/047* (2006.01)
*C22C 19/03* (2006.01)

(52) U.S. Cl. ..... 148/312; 148/402; 420/459

(58) Field of Classification Search ..... None
See application file for complete search history.

(56) References Cited

U.S. PATENT DOCUMENTS

2003/0051774 A1 3/2003 Saito et al.
2005/0237139 A1* 10/2005 Marioni ..... 335/220

FOREIGN PATENT DOCUMENTS

| | | | |
|---|---|---|---|
| JP | 10-259438 | A | 9/1998 |
| JP | 2001-279357 | A | 10/2001 |
| JP | 2001-279360 | A | 10/2001 |
| JP | 2002-129273 | A | 5/2002 |
| JP | 2002-356748 | A | 12/2002 |
| WO | WO 02-14565 | A1 | 2/2002 |
| WO | WO 02/14565 | A1 | 2/2002 |

OTHER PUBLICATIONS

Machine translation of JP 2001-279357A, published Oct. 10, 2001.*
Yosuke Kon'no et al.; "Ni-Mn-X (X-In, Sn, Sb)-Kei Heusler Gokin ni Okeru Martensite Hentai no Jiki Hentai Kyodo", The Japan Institute of Metals Koen Gaiyo, vol. 135, 2004, p. 580.

(Continued)

*Primary Examiner* — George Wyszomierski
(74) *Attorney, Agent, or Firm* — Sughrue Mion, PLLC

(57) ABSTRACT

A ferromagnetic shape memory alloy comprising 25-50 atomic % of Mn, 5-18 atomic % in total of at least one metal selected from the group consisting of In, Sn and Sb, and 0.1-15 atomic % of Co and/or Fe, the balance being Ni and inevitable impurities, which has excellent shape memory characteristics in a practical temperature range, thereby recovering its shape by a magnetic change caused by a magnetic-field-induced reverse transformation in a practical temperature range.

19 Claims, 6 Drawing Sheets

OTHER PUBLICATIONS

Takeshi Kanomata et al.; "Ni2Mn1-xFexGa (0≦x≦0.7) no Jiki Tokusei", The Japan Institute of Metals Koen Gaiyo, vol. 133, 2003, p. 271.

Imano et al., "Magnetic Transformation Behavior of Martensitic Transformation in a Heulser Alloy Ni-Mn-X (X=In, Sn, Sb)," pp. 580, Poster Session in Autumn Meeting, the Japan Institute of Metals (2004).

Shikamata, et al., Magnetic Characteristic of $Ni_2MN_{1-x}Fe_xGa$ (0≦x≦0.7), pp. 271, Summary of Autumn Meeting, the Japan Institute of Metals (2003).

* cited by examiner

FERROMAGNETIC SHAPE MEMORY ALLOY AND ITS USE

This is a 371 of PCT/JP2006/312835 filed Jun. 27, 2006 and claims the priority of Japanese Application No. 2005-186663 filed Jun. 27, 2005, both of which are incorporated by reference herein.

FIELD OF THE INVENTION

The present invention relates to a ferromagnetic shape memory alloy and its use, particularly to a ferromagnetic shape memory alloy capable of doing shape recovery accompanied by magnetic change by a magnetic-field-induced reverse transformation in a practical temperature range, and its use.

BACKGROUND OF THE INVENTION

A shape memory alloy has a remarkable shape memory function caused by a martensitic transformation and a martensitic reverse transformation, thereby being useful as an actuator material, etc. An actuator formed by a shape memory alloy is usually driven by heat, with a martensitic transformation by cooling, and a martensitic reverse transformation by heating. In the shape memory alloy, a transformation temperature during cooling is generally higher than a reverse transformation temperature during heating. The difference between the transformation temperature and the reverse transformation temperature is called "temperature hysteresis." In a thermoelastic martensitic transformation with a small temperature hysteresis, a large shape recovery strain of up to about 5% is usually obtained. However, because a heat-driven actuator has a cooling speed determined by heat dissipation, its response speed is slow.

Thus, attention has been paid to ferromagnetic shape memory alloys such as Ni—Co—Al alloys, Ni—Mn—Ga alloys, etc. undergoing a twinning deformation of a martensite phase induced by a magnetic field. A magnetic-field-induced strain can be obtained in the ferromagnetic shape memory alloy, which is thus promising as an actuator material having a high response speed.

JP 2002-129273 A proposes an actuator member formed by a ferromagnetic shape memory alloy having a composition comprising 5-70 atomic % of Co, 5-70 atomic % of Ni, and 5-50 atomic % of Al, the balance being inevitable impurities, which has a single-phase structure of a β phase having a B2 structure, or a two-phase structure comprising a γ phase and a β phase having a B2 structure. However, even if a magnetic field were applied to this ferromagnetic shape memory alloy, its martensitic transformation temperature would not drastically change, being difficult in causing a martensitic transformation and a martensitic reverse transformation in a practical temperature range. Accordingly, magnetically driving actuators formed by this ferromagnetic shape memory alloy would not have sufficient characteristics at room temperature. Thus, a strong magnetic field is now applied to a ferromagnetic shape memory alloy having only a martensite phase to cause a large twin-crystal magnetostriction. This method is, however, disadvantageous in failing to obtain a large strain unless the ferromagnetic shape memory alloy is a single crystal.

JP 10-259438 A proposes a Ni—Mn—Ga alloy showing a shape memory effect by a magnetic field at an daily life temperature, which has a chemical composition of $Ni_{2+x}Mn_{1-x}Ga$, wherein $0.10 \leqq x \leqq 0.30$ by mol, and a martensitic reverse transformation-finishing temperature of −20° C. or higher. However, this Ni—Mn—Ga alloy does not have a sufficient shape recovery strain.

As a Mn alloy exhibiting larger strain than that of the Ni—Mn—Ga alloy, JP 2001-279360 A proposes a Mn alloy represented by the general formula of $Mn_aT_bX_{1-a-b}$, wherein T is at least one selected from the group consisting of Fe, Co and Ni, X is at least one selected from the group consisting of Si, Ge, Al, Sn and Ga, and a and b are numbers meeting $0.2 \leqq a \leqq 0.4$, and $0.2 \leqq b \leqq 0.4$, and undergoing a martensitic transformation, whose reverse transformation-finishing temperature is in a range of −20° C. to 300° C. However, this Mn alloy fails to exhibit a large strain, because of a magnetic field-induced transformation from a paramagnetic parent phase (matrix phase) to a ferromagnetic martensite phase.

As a magnetic shape memory alloy exhibiting large strain ratio and displacement by crystal transformation, JP 2001-279357 A proposes a magnetic shape memory alloy represented by the general formula of $M1_{2-x}M2_yM3_z$, wherein M1 is Ni and/or Cu, M2 is at least one selected from the group consisting of Mn, Sn, Ti and Sb, M3 is at least one selected from the group consisting of Si, Mg, Al, Fe, Co, Ga and In, and x, y and z are numbers meeting $0<x \leqq 0.5$, $0<y \leqq 1.5$, and $0<z \leqq 1.5$, having a Heusler structure, and causing a martensitic transformation and a magnetic-field-induced martensitic reverse transformation. This reference describes that the alloy's shape changes by a magnetic field, but all Examples are directed to a magnetic field-induced transformation occurring after a temperature transformation, no Examples showing a martensitic reverse transformation caused only by the change of a magnetic field.

Proposal has been made to provide a thermomagnetic-driving device utilizing the phenomenon that a ferromagnetic shape memory alloy changes between a ferromagnetic state and a paramagnetic state depending on the temperature change. JP 10-259438 A and JP 2002-129273 A describe that ferromagnetic shape memory alloys having compositions optimized to show a magnetic transformation at a daily life temperature are used for actuators. However, there is no sufficient energy conversion efficiency in the magnetic transformation between a ferromagnetic state and a paramagnetic state.

Proposal has also been made to utilize a ferromagnetic shape memory alloy as a magnetic freezer. Magnetic freezing utilizes a magnetocaloric effect, which is a phenomenon that when a magnetic body is isothermally magnetized from a paramagnetic state to a ferromagnetic state, causing a magnetic entropy change due to the difference in the degree of freedom in electromagnetic spin, and then adiabatically deprived of a magnetic field, the temperature of the magnetic body decreases.

As a magnetic material performing magnetic freezing by a relatively weak magnetic field in a room temperature range, JP 2002-356748 A proposes (a) a magnetic-freezer comprising at least one metal selected from the group consisting of Fe, Co, Ni, Mn and Cr in a total amount of 50-96 atomic %, at least one metal selected from the group consisting of Si, C, Ge, Al, B, Ga and In in a total amount of 4-43 atomic %, and at least one metal selected from the group consisting of Y, La, Ce, Pr, Nd, Sm, Eu, Gd, Tb, Dy, Ho, Er, Tm and Yb in a total amount of 4-20 atomic %, and (b) a magnetic-freezer comprising at least one metal selected from the group consisting of Fe, Co, Ni, Mn and Cr in a total amount of 50-80 atomic %, and at least one metal selected from the group consisting of Sb, Bi, P and As in a total amount of 20-50 atomic %. However, these magnetic freezers show sufficient magnetic entropy change only at −40° C. or lower, being not usable in practical applications. Accordingly, magnetic freezers exhibiting sufficient magnetic entropy change at around room temperature are desired.

OBJECTS OF THE INVENTION

Accordingly, an object of the present invention is to provide a ferromagnetic shape memory alloy exhibiting excellent shape memory characteristics in response to a temperature change and a magnetic field change in a practical temperature range.

Another object of the present invention is to provide a magnetic-driving device and a thermomagnetic-driving device each formed by such a ferromagnetic shape memory alloy.

A further object of the present invention is to provide a heat-generating/absorbing device (particularly magnetic-freezer), a stress-magnetism device, a stress-resistance device, and a magnetism-resistance device utilizing the magnetic field-temperature characteristics, stress-magnetism characteristics, stress-resistance characteristics and magnetism-resistance characteristics, respectively, of the above ferromagnetic shape memory alloy.

DISCLOSURE OF THE INVENTION

As a result of intense research in view of the above objects, the inventors have found that the adjustment of the composition of a Ni-based alloy comprising Mn, at least one selected from the group consisting of In, Sn and Sb, and Co and/or Fe can provide a ferromagnetic shape memory alloy exhibiting excellent shape memory characteristics in response to a temperature change and a magnetic field change in a practical temperature range. The present invention has been completed based on such findings.

Thus, the first ferromagnetic shape memory alloy of the present invention comprises 25-50 atomic % of Mn, 5-18 atomic % in total of at least one metal selected from the group consisting of In, Sn and Sb, and 0.1-15 atomic % of Co and/or Fe, the balance being Ni and inevitable impurities. This ferromagnetic shape memory alloy preferably comprises more than 40 atomic % of Ni.

The second ferromagnetic shape memory alloy of the present invention comprises 25-50 atomic % of Mn, 5-18 atomic % in total of at least one metal selected from the group consisting of In, Sn and Sb, 0.1-15 atomic % of Co and/or Fe, 0.1-15 atomic % in total of at least one metal selected from the group consisting of Ti, Pd, Pt, Al, Ga, Si, Ge, Pb and Bi, and more than 40 atomic % of Ni, the balance being inevitable impurities.

The third ferromagnetic shape memory alloy of the present invention comprises 25-50 atomic % of Mn, 5-18 atomic % in total of at least one metal selected from the group consisting of In, Sn and Sb, 0.1-15 atomic % of Co and/or Fe, and 0.1-15 atomic % in total of at least one metal selected from the group consisting of Pd, Pt, Pb and Bi, the balance being Ni and inevitable impurities. Such ferromagnetic shape memory alloy preferably comprises more than 40 atomic % of Ni.

Any one of the first to third ferromagnetic shape memory alloys has a ferromagnetic parent phase (matrix phase) and a paramagnetic, antiferromagnetic or ferrimagnetic martensite phase with a large difference in magnetization between the parent phase and the martensite phase. The martensite phase preferably has a long-period stacking structure to enable a reversible transformation with small temperature hysteresis. In any one of the first to third ferromagnetic shape memory alloys, the magnetization difference is 50 emu/g or more between a parent phase (measured at a martensitic transformation-starting temperature) and a martensite phase (measured at a martensitic transformation-finishing temperature) when a magnetic field of 20 kOe or more, for instance, is applied. A $\rho_M/\rho_p$ ratio of the electric resistance $\rho_m$ of the martensite phase to the electric resistance $\rho_p$ of the parent phase is 2 or more.

The magnetic-driving device of the present invention comprises any one of the first to third ferromagnetic shape memory alloys, utilizing shape recovery and/or magnetic change induced by applying a magnetic field to the ferromagnetic shape memory alloy. In this case, (a) when a magnetic field is applied to the ferromagnetic shape memory alloy in a state of a paramagnetic, antiferromagnetic or ferrimagnetic martensite phase, the martensite phase is subjected to a martensitic reverse transformation to the ferromagnetic parent phase, and (b) when a magnetic field is removed from the ferromagnetic shape memory alloy having a parent phase structure obtained by the a magnetic-field-induced reverse transformation, the parent phase is subjected to a martensitic transformation to the martensite phase.

The thermomagnetic-driving device of the present invention comprises any one of the first to third ferromagnetic shape memory alloys as a temperature-sensitive magnetic body, utilizing (a) shape change and/or magnetism change caused by a martensitic reverse transformation to a ferromagnetic parent phase induced by heating the ferromagnetic shape memory alloy in a state of a paramagnetic, antiferromagnetic or ferrimagnetic martensite phase, and/or (b) shape change and/or magnetism change caused by a transformation to the martensite phase induced by cooling the ferromagnetic shape memory alloy in a state of the parent phase.

The magnetic freezer of the present invention is formed by any one of the first to third ferromagnetic shape memory alloys, utilizing heat absorption caused by a martensitic reverse transformation to a ferromagnetic parent phase induced by applying a magnetic field to the ferromagnetic shape memory alloy in a state of a paramagnetic, antiferromagnetic or ferrimagnetic martensite phase.

The heat-generating/absorbing device of the present invention comprises any one of the first to third ferromagnetic shape memory alloys, utilizing (a) heat generation caused by a martensitic transformation of the ferromagnetic shape memory alloy in a state of a ferromagnetic parent phase, and (b) heat absorption caused by a martensitic reverse transformation of the ferromagnetic shape memory alloy in a state of a paramagnetic, antiferromagnetic or ferrimagnetic martensite phase. The martensitic transformation is induced by applying stress to the ferromagnetic shape memory alloy in a state of a parent phase, or by removing a magnetic field from the ferromagnetic shape memory alloy in a state of a parent phase generated by a magnetic-field-induced reverse transformation. The martensitic reverse transformation is induced by applying a magnetic field to the ferromagnetic shape memory alloy in a state of a martensite phase, or by removing stress from the ferromagnetic shape memory alloy in a state of a martensite phase generated by a stress-induced transformation.

The stress-magnetism device of the present invention comprises any one of the first to third ferromagnetic shape memory alloys, utilizing (a) magnetic change caused by a transformation to a paramagnetic, antiferromagnetic or ferrimagnetic martensite phase by applying stress to the ferromagnetic shape memory alloy in a state of a ferromagnetic parent phase, and/or (b) magnetic change caused by a reverse transformation to a parent phase induced by removing stress from the ferromagnetic shape memory alloy in a state of a martensite phase generated by a stress-induced transformation.

The stress-resistance device of the present invention comprises any one of the first to third ferromagnetic shape memory alloys, utilizing (a) electric resistance change caused by a transformation to a paramagnetic, antiferromagnetic or ferrimagnetic martensite phase induced by applying stress to the ferromagnetic shape memory alloy in a state of a ferromagnetic parent phase, and/or (b) electric resistance change caused by a reverse transformation to a parent phase induced by removing stress from the ferromagnetic shape memory alloy in a state of a martensite phase generated by a stress-induced transformation.

The magnetoresistance device of the present invention comprises any one of the first to third ferromagnetic shape memory alloys, utilizing (a) electric resistance change caused by a martensitic reverse transformation to a ferromagnetic parent phase induced by applying a magnetic field to the ferromagnetic shape memory alloy in a state of a paramagnetic, antiferromagnetic or ferrimagnetic martensite phase, and/or (b) electric resistance change caused by a transformation to a martensite phase induced by removing a magnetic field from the ferromagnetic shape memory alloy in a state of a parent generated by a magnetic-field-induced reverse transformation.

F*ig.*8 is a graph showing another magnetic field-induced shape recovery strain in the ferromagnetic shape memory alloy of Example 23.

Figure 9:
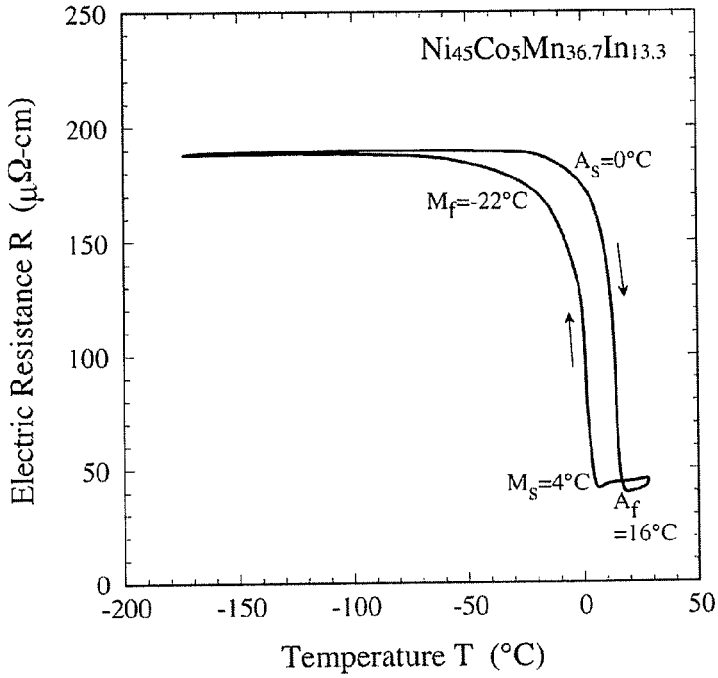

FIG. 9 is a graph showing a temperature-electric resistance curve of the ferromagnetic shape memory alloy of Example 24.

Figure 10:
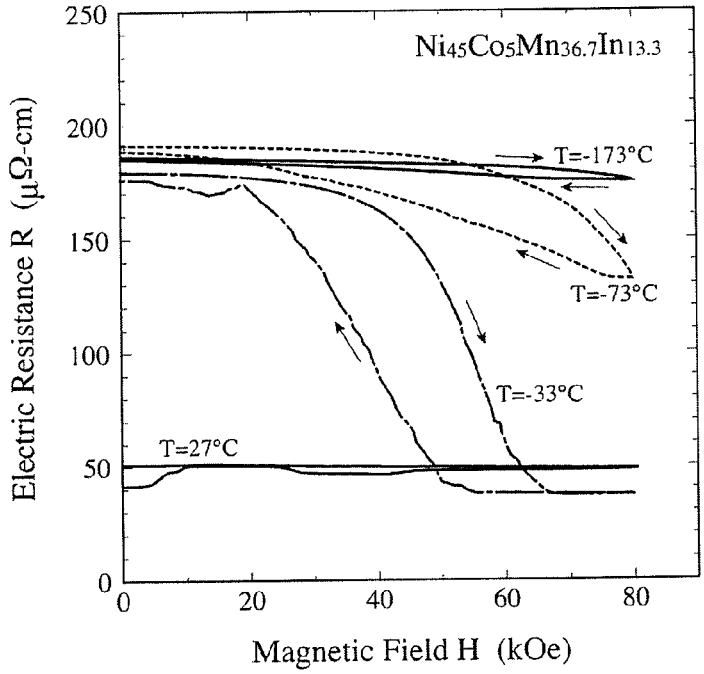

FIG. 10 is a graph showing a magnetic field-electric resistance curve of the ferromagnetic shape memory alloy of Example 24.

Figure 11:
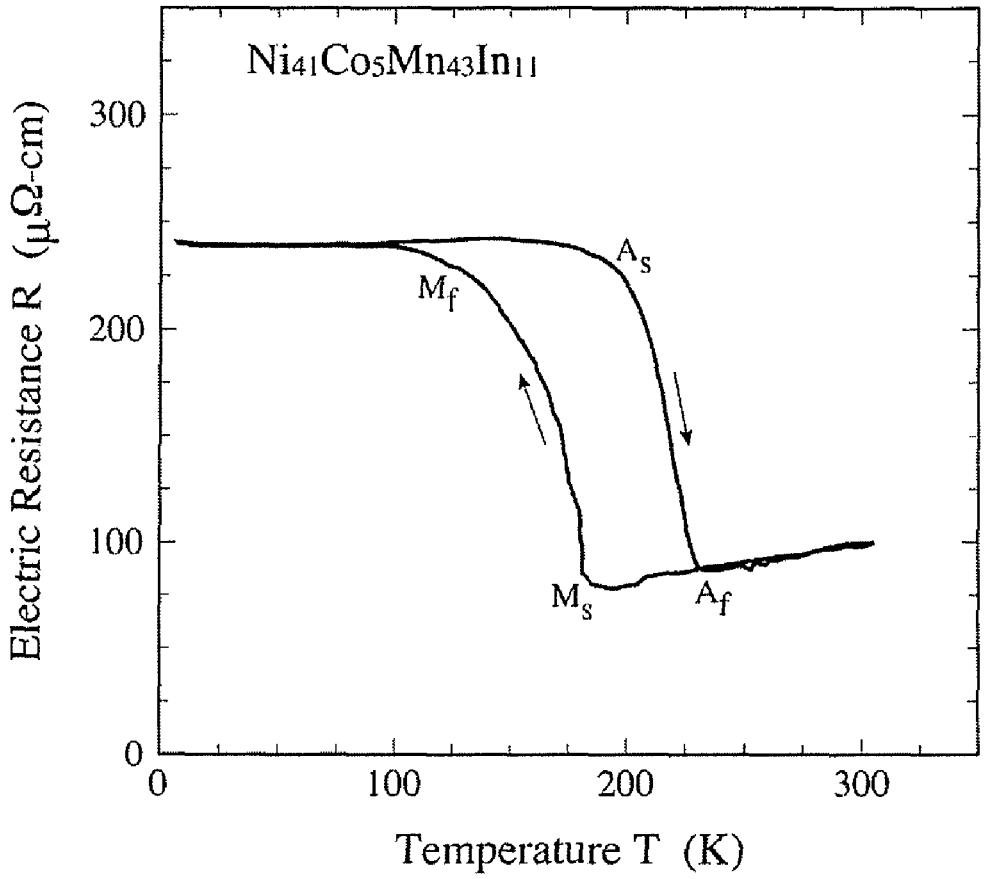

FIG. 11 is a graph showing a temperature-electric resistance curve of the ferromagnetic shape memory alloy of Example 25.

DESCRIPTION OF THE BEST MODE OF THE INVENTION

[1] Ferromagnetic Shape Memory Alloy

The ferromagnetic shape memory alloy according to each embodiment of the present invention will be explained below in detail, and the explanation of each embodiment is applicable to other embodiments unless otherwise particularly mentioned.

(1) First Ferromagnetic Shape Memory Alloy

The first ferromagnetic shape memory alloy comprises 25-50 atomic % of Mn, 5-18 atomic % in total of at least one metal selected from the group consisting of In, Sn and Sb, and 0.1-15 atomic % of Co and/or Fe, the balance being Ni and inevitable impurities. The amount of each element is expressed based on 100 atomic % of the entire alloy here, unless otherwise mentioned.

Mn is an element accelerating the formation of a ferromagnetic parent phase (matrix phase) having a bcc structure. The adjustment of the Mn content can change a martensitic transformation-starting temperature (Ms) and a martensitic transformation-finishing temperature (Mf), a martensitic reverse transformation-starting temperature (As), a martensitic reverse transformation-finishing temperature (Af), and a Curie temperature (Tc). When the Mn content is less than 25 atomic %, a martensitic transformation does not occur. When the Mn content is more than 50 atomic %, the ferromagnetic shape memory alloy does not have a parent phase only. The preferred Mn content is 28-45 atomic %.

In, Sn and Sb are elements improving magnetic properties. The adjustment of the amounts of these elements can change Ms and Tc, strengthening the alloy structure. When the total amount of these elements is less than 5 atomic %, the Ms is equal to or higher than Tc. When it is more than 18 atomic %, the martensitic transformation does not occur. The total amount of these elements is preferably 7-16 atomic %, more preferably 10-16 atomic %.

Co and Fe have a function to increase Tc. When the total amount of these elements exceeds 15 atomic %, the alloy is likely to become brittle. The total amount of these elements is preferably 0.5-8 atomic %.

Ni is an element improving shape memory characteristics and magnetic properties. With insufficient Ni, the alloy loses ferromagnetism. On the other hand, when Ni is excessive, a shape memory effect does not appear. To obtain excellent shape memory characteristics and ferromagnetism, the Ni content is preferably more than 40 atomic %, more preferably 42 atomic % or more, particularly 45 atomic % or more.

(2) Second Ferromagnetic Shape Memory Alloy

The second ferromagnetic shape memory alloy has the same composition as that of the first ferromagnetic shape memory alloy, except that 0.1-15 atomic % in total of at least one metal selected from the group consisting of Ti, Pd, Pt, Al, Ga, Si, Ge, Pb and Bi is contained, and that more than 40 atomic % of Ni is indispensable. More than 40 atomic % of Ni provides excellent shape memory characteristics and magnetic properties.

At least one metal selected from the group consisting of Ti, Pd, Pt, Al, Ga, Si, Ge, Pb and Bi improves shape memory characteristics, and the adjustment of its amount changes Ms and Tc. Among them, Ti, Al, Ga, Si and Ge have a function to stabilize the long-period stacking of the martensite phase (M phase). Pd, Pt, Pb and Bi have a function to stabilize a paramagnetic phase, an antiferromagnetic phase or a ferrimagnetic phase constituting the M phase, particularly a paramagnetic phase or an antiferromagnetic phase. When the total amount of these elements is more than 15 atomic %, the alloy is likely brittle. The total amount of these elements is preferably 0.5-8 atomic %.

(3) Third Ferromagnetic Shape Memory Alloy

The third ferromagnetic shape memory alloy has the same composition as that of the first ferromagnetic shape memory alloy, except for containing 0.1-15 atomic % in total of at least one metal selected from the group consisting of Pd, Pt, Pb and Bi. The total amount of these elements is preferably 0.5-8 atomic %.

[2] Production Method of Ferromagnetic Shape Memory Alloy

The ferromagnetic shape memory alloy in any embodiment may be produced by casting, hot working (hot rolling, etc.), cold working (cold rolling, pressing, etc.), a solution treatment, and an aging treatment. Because the ferromagnetic shape memory alloy has good hot and cold workability, it can be formed into thin wires, plates, etc. With respect to the casting, the hot working and the cold working, they may be conducted as in the case of usual shape memory alloys.

(1) Solution Treatment

The cold-worked alloy is subjected to a solution treatment comprising heating to a solution temperature, transformation to a parent phase (bcc phase), and rapid cooling. The solution temperature is preferably 700° C. or higher, more preferably 750-1,100° C. The solution temperature may be kept for 1 minute or more. Though not restrictive, the rapid-cooling speed is preferably 50° C./second or more. Rapidly cooling after heating provides a ferromagnetic shape memory alloy with a parent phase structure, and when the Mf of the alloy is lower than room temperature, the alloy structure is substantially composed of an M phase.

(2) Aging Treatment

An aging treatment after the solution treatment preferably strengthens the alloy matrix, resulting in improved shape memory characteristics. The aging treatment is conducted at a temperature of 100° C. or higher. The aging at lower than 100° C. fails to provide a sufficient effect. The upper limit of the aging temperature is preferably 700° C., though not restrictive. The aging time is preferably 1 minute or more, more preferably 30 minutes or more, though variable depending on the aging temperature and the composition of the ferromagnetic shape memory alloy. The upper limit of the aging time is not particularly restricted unless the parent phase is precipitated.

[3] Structure of Ferromagnetic Shape Memory Alloy

The structure of the ferromagnetic shape memory alloy at room temperature has a parent phase having a bcc structure when its Mf is lower than room temperature, and a martensite phase when its Mf is higher than room temperature. To obtain excellent magnetic properties, the parent phase preferably has a Heusler structure. Any of the parent phase and the martensite phase preferably has a single-phase structure, which may be single-crystalline or polycrystalline. The single crystal has higher shape memory characteristics and magnetic properties. The single crystal structure may be obtained, for instance, by known methods such as an annealing method, a Czochralski method, etc. When a single crystal is formed by an annealing method, annealing is preferably conducted at a temperature of 800-1100° C. The annealing time is preferably 30 minutes to 1 week.

The ferromagnetic shape memory alloy is subjected to a thermoelastic martensitic transformation and a thermoelastic martensitic reverse transformation between a ferromagnetic parent phase having a bcc structure and a paramagnetic, antiferromagnetic or ferrimagnetic martensite phase. The M phase has a stacking layer structure of 2M, 6M, 10M, 14M, 4O, etc., wherein each number represents the stacking period of a close-packed plane (<001> plane), M represents a monoclinic crystal, and O represents an orthorhombic crystal. To provide a small temperature hysteresis, the long-period stacking structures of 6M, 10M, 14M, 4O, etc. are preferable.

[4] Characteristics of Ferromagnetic Shape Memory Alloy (1) Shape Memory Characteristics The ferromagnetic shape memory alloy having Mf higher than a practical temperature range has a martensite phase in the practical temperature range, stably exhibiting good shape memory characteristics. The shape recovery ratio [=100× (applied strain−remaining strain)/applied strain] of the ferromagnetic shape memory alloy is about 95% or more, substantially 100%.

(2) Superelasticity

The ferromagnetic shape memory alloy having Af lower than a practical temperature range stably exhibits good superelasticity in the practical temperature range. Even with an applied strain of 6-8%, the shape recovery ratio after relieving deformation is usually 95% or more.

(3) Transformation Characteristics (a) Magnetic-field-induced Reverse Transformation Characteristics When a magnetic field is applied to the ferromagnetic shape memory alloy having a paramagnetic, antiferromagnetic or ferrimagnetic M phase, the M phase is subjected to a martensitic reverse transformation to the ferromagnetic parent phase. And when a magnetic field is removed, a martensitic transformation occurs to return to the M phase. Thus, a two-way shape memory effect is obtained.

The ferromagnetic shape memory alloy stores a magnetic energy (Zeeman energy) of a magnetic field when it is in the parent phase, though not when it is in the M phase. Thus, there is a large magnetization difference between the parent phase and the M phase. For instance, when a magnetic field of 20 kOe (1,592 kA/m) is applied to the ferromagnetic shape memory alloy of Example 1, a magnetization difference is 50 emu/g or more between the parent phase subjected to a magnetic-field-induced martensitic reverse transformation and the martensite phase subjected to a martensitic transformation.

When a magnetic field is applied to the ferromagnetic shape memory alloy, Ms, Mf, As and Af drastically decrease by the Zeeman energy, and the M phase is reverse-transformed to a stable parent phase. To have the martensitic reverse transformation occur at a practical temperature range, usually −150° C. to +100° C., the magnetic field intensity is preferably about 5-100 kOe (about 398-7,958 kA/m) though not restrictive.

(b) Thermoelastic Transformation Characteristics

A thermoelastic martensitic transformation/reverse transformation occurs in the ferromagnetic shape memory alloy. The Ms and As of the ferromagnetic shape memory alloy is usually in a range of about −200° C. to about +100° C. without a magnetic field. The difference of Tc and Ms is 40° C. or more, so that there is a ferromagnetic parent phase in a wide temperature range. The Ms may be adjusted by the formulations of elements (for instance, amounts of Mn, In, Sn and Sb). In the case of the second ferromagnetic shape memory alloy, the amounts of Ti, Fe, Co, Pd, Pt, Al, Ga, Si, Ge, Pb and Bi may be adjusted. The martensite phase of the ferromagnetic shape memory alloy of the present invention is paramagnetic, antiferromagnetic or ferrimagnetic, and higher transformation energy is obtained when it is antiferromagnetic or ferrimagnetic than when it is paramagnetic.

(c) Stress-induced Transformation Characteristics

A martensitic transformation occurs when stress is applied to the ferromagnetic shape memory alloy in a state of a parent phase, and a martensitic reverse transformation occurs when stress is removed.

(4) Electric Resistance Characteristics

The ferromagnetic shape memory alloy has much larger electric resistance when it has an M phase than when it has a parent phase. A $\rho_M/\rho_p$ ratio of the electric resistance $\rho_M$ of the M phase to the electric resistance $\rho_p$ of the parent phase is 2 or more without a magnetic field. Thus obtained is a device having electric resistance changeable by a martensitic transformation and a martensitic reverse transformation induced by a temperature, a magnetic field or stress. Particularly when a magnetic field is applied or removed at a temperature of (Mf −100° C.) or higher and lower than Mf, a giant magnetoresistance effect of reversibly changing the electric resistance is obtained.

[5] Applications of Ferromagnetic Shape Memory Alloy (1) Magnetic Field-driven Device Using the ferromagnetic shape memory alloy of the present invention subjected to a magnetic-field-induced martensitic reverse transformation, magnetic-driving devices having a high response speed and large output, such as a magnetic field-driven micro-actuator, a magnetic field-driven switch, etc. are obtained. The magnetic-driving device comprises a driving body (rotating body, deforming body, moving body, etc.) formed by the ferromagnetic shape memory alloy, utilizing shape change and/or magnetic change occurring in the driving body by applying a magnetic field, though not restrictive. The application of a pulse magnetic field increases the response speed of the magnetic-driving device. To continuously operate the magnetic-driving device at a high response speed, the temperature lower than Mf is preferable.

(2) Thermomagnetic-driving Device

The use of the ferromagnetic shape memory alloy of the present invention as a temperature-sensitive magnetic body provides a thermomagnetic-driving device with high energy efficiency. The thermomagnetic-driving device comprises, for instance, a driving body (rotating body, deforming body, moving body, etc.) formed by the ferromagnetic shape memory alloy, a heating means (laser-irradiating means, infrared ray-irradiating means, etc.), and a magnetic field-applying means (permanent magnet, etc.), utilizing magnetic change occurring in the driving body by heating to generate power, though not restrictive. Examples of the thermomagnetic-driving device using the ferromagnetic shape memory alloy of the present invention include a current switch and a flow-controlling valve utilizing the principle that a temperature-sensitive magnetic body is attracted to a permanent magnet when heated and separates from the magnet when cooled, a thermomagnetic motor in which a temperature-sensitive magnetic body is partially heated to become ferromagnetic and driven under the action of a permanent magnet, etc. The details of these thermomagnetic-driving devices are described in JP 2002-129273 A.

Figure 1:
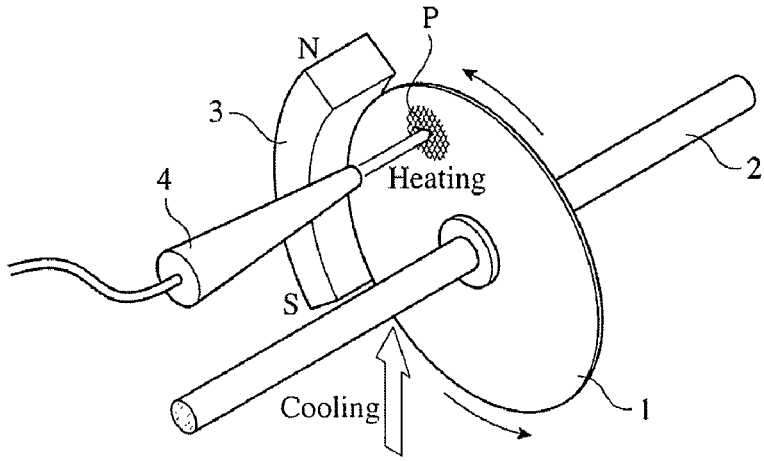
FIG. 1 is a perspective view showing a thermomagnetic motor, an example of thermomagnetic-driving devices using the ferromagnetic shape memory alloy of the present invention as a temperature-sensitive magnetic body.

FIG. 1 shows an example of thermomagnetic motors using the ferromagnetic shape memory alloy of the present invention as a temperature-sensitive magnetic body. This thermomagnetic motor comprises a disc-shaped, temperature-sensitive magnetic body 1 formed by the ferromagnetic shape memory alloy having an M phase that is paramagnetic, antiferromagnetic or ferrimagnetic at a use temperature, a shaft 2 rotatable integrally with the temperature-sensitive magnetic body 1, a permanent magnet 3 disposed around the temperature-sensitive magnetic body 1 to apply a magnetic field thereto, and a laser gun 4 for heating part of the temperature-sensitive magnetic body 1. In the depicted example, the temperature-sensitive magnetic body 1 is heated at a position slightly upstream of the magnetic pole (for instance, N pole) of the permanent magnet 3. The M phase is reverse-transformed to the ferromagnetic parent phase in a heated region P, while the M phase remains unchanged in the other range. As a result, only the heated region P is attracted to the nearest magnetic pole (N pole) of the permanent magnet 3, so that the temperature-sensitive magnetic body 1 is rotated. To secure the attraction of the heated region P, as shown in FIG. 1, it is preferable to cool the temperature-sensitive magnetic body 1 in the other area than the heated region P, for instance, by blowing a coolant such as cold air, etc. from below the temperature-sensitive magnetic body 1. The number of rotation of the temperature-sensitive magnetic body 1 may be controlled by the heating and cooling temperatures.

(3) Magnetic Freezer

When a magnetic field is applied to the ferromagnetic shape memory alloy having an M phase, a martensitic reverse transformation accompanied by heat absorption occurs, resulting in a large magnetic entropy change in a practical temperature range (particularly from about room temperature to about 100° C.). With a magnetic field change of 0-90 kOe (0-7,162 kA/m) at 21° C., for instance, the magnetic entropy change is about 20 J/kgK. Such a large magnetic heat absorption effect provides a magnetic freezer having high freezing power. The use of the magnetic freezer of the present invention provides, for instance, a magnetic freezing system comprising (a) a chamber filled with the magnetic freezer, (b) a magnetic field-applying permanent magnet disposed near the magnetic freezing chamber, (c) a coolant heat-exchanged with the magnetic freezer, and (d) a piping for circulating the coolant.

(4) Heat-generating or Absorbing Device

Using the ferromagnetic shape memory alloy of the present invention, a heat-generating device utilizing heat generation caused by a martensitic transformation, or a heat-absorbing device utilizing heat absorption caused by a martensitic reverse transformation can be obtained. The heat-generating or absorbing device of the present invention can be utilized, for instance, as an automatic temperature-controlling device. The structure of the heat-generating or absorbing device is not particularly restricted, as long as it comprises a heat-generating body and/or a heat-absorbing body formed by the ferromagnetic shape memory alloy.

(5) Stress-magnetism Device

The ferromagnetic shape memory alloy subjected to a stress-induced martensitic transformation and a stress-induced martensitic reverse transformation at a temperature above the Af can be used for a stress-magnetism device utilizing magnetic change caused by a transformation and a reverse transformation. The stress-magnetism device includes, for instance, a strain sensor (stress sensor) for detecting magnetic change caused by the application or removal of stress, etc. The structure of the stress-magnetism device is not particularly restricted, as long as it comprises, for instance, a detector formed by the ferromagnetic shape memory alloy, and a means (magnetic sensor such as a pickup coil, etc.) for detecting the magnetic change generated in the detector.

(6) Stress-resistance Device

Using the ferromagnetic shape memory alloy of the present invention, a stress-resistance device such as a strain sensor (stress sensor), etc., which utilizes electric resistance change caused by a stress-induced martensitic transformation and a stress-induced martensitic reverse transformation, can be obtained. The structure of the stress-resistance device is not particularly restricted, as long as it comprises, for instance, a detector formed by the ferromagnetic shape memory alloy, and a means (for instance, ammeter) for detecting the electric resistance change generated in the detector.

(7) Magnetoresistance Device

The ferromagnetic shape memory alloy of the present invention having a magnetoresistance effect can be used for a magnetoresistance device for detecting a magnetic field. The structure of the magnetoresistance device is not particularly restricted, as long as it comprises, for instance, electrodes attached to two points of a ferromagnetic shape memory alloy member. The magnetoresistance device using the ferromagnetic shape memory alloy of the present invention can be used, for instance, as a magnetic head, etc.

(8) Temperature Sensor

The attachment of a magnetic sensor such as a pickup coil to pluralities of ferromagnetic shape memory alloy members having different Ms provides a temperature sensor, because it is possible to identify which ferromagnetic shape memory alloy member (having known Ms) has magnetically changed depending on the temperature change.

The present invention will be described in more detail with Examples below without intention of restricting the scope of the present invention.

EXAMPLES 1-20 AND COMPARATIVE EXAMPLES 1-4

Each alloy having the composition shown in Table 1 was high-frequency-melted and rapidly cooled to form an ingot. A plate piece of 5 mm in width, 10 mm in length, and 5 mm in thickness was cut out of each ingot, subjected to a solution treatment at 900° C. for 1 day, and then charged into water for rapidly cooling. The properties of the resultant each sample were measured by the following methods. The measurement results are shown in Table 1.

(1) Tc and Ms

A test piece of 2 mm×2 mm×1 mm cut out of each sample was measured with respect to Tc and Ms by differential scanning calorimetry (DSC) at a heating/cooling speed of 10° C./minute.

(2) Crystal Structure

Each sample in a parent phase and an M phase was pulverized, relieved of strain at 600° C., and then analyzed by an X-ray diffraction method.

(3) Magnetization

The magnetization of a test piece of 1 mm×1 mm×1 mm cut out of each sample was measured by a superconducting quantum interference device (SQUID) in a magnetic field of 0.5-20 kOe at a heating/cooling speed of 2° C./minute.

(4) Electric Resistance

The electric resistance of a test piece of 1 mm×1 mm×10 mm cut out of each sample was measured by a four-terminal method without a magnetic field at a heating/cooling speed of 2° C./minute.

TABLE 1

| Example No. | Alloy Composition (atomic %)(1) Ni | Mn | In | Sn | Sb | Co | Fe | Other Elements | Tc (° C.) | Ms (° C.) |
|---|---|---|---|---|---|---|---|---|---|---|
| 1 | 47 | 34 | 15.5 | — | 0.5 | 2 | — | Al: 1 | 40 | −20 |
| 2 | 44.6 | 34.7 | 15.2 | — | — | 1 | 1.5 | Pd: 3 | 70 | 25 |
| 3 | 45 | 36.5 | 13.5 | — | — | 5 | — | — | 106 | 13 |
| 4 | 45 | 36.6 | 13.4 | — | — | 5 | — | — | 101 | 32 |
| 5 | 45 | 36.7 | 13.3 | — | — | 5 | — | — | 104 | 50 |
| 6 | 42.5 | 37.4 | 12.6 | — | — | 7.5 | — | — | 120 | 0 |
| 7 | 42.5 | 37 | 12.5 | — | — | 7.5 | 0.5 | — | 140 | 12 |
| 8 | 40.7 | 37.6 | 12.2 | — | — | 7.5 | — | Pt: 2 | 142 | 65 |
| 9 | 42.5 | 37.8 | 12.2 | — | — | 7.5 | — | — | 156 | 89 |
| 10 | 43 | 38 | 12 | — | — | 6.5 | — | Bi: 0.5 | 152 | 98 |
| 11 | 45.5 | 28 | 12 | — | — | 1.5 | 13 | — | 120 | −60 |
| 12 | 42.5 | 41 | 14 | — | — | — | 2 | Pb: 0.5 | 60 | −35 |
| 13 | 44 | 39 | 12 | 3 | 1 | 0.5 | 0.5 | — | 30 | −25 |
| 14 | 41 | 43 | 11 | — | — | 5 | — | — | 134 | −24 |
| 15 | 49 | 36.5 | — | 14 | — | — | 0.5 | — | 85 | 10 |
| 16 | 48.2 | 37.4 | — | 12.4 | — | 0.8 | 0.2 | Si: 1 | 60 | 20 |
| 17 | 42.5 | 41 | — | 11 | — | 5 | — | Ti: 0.5 | 100 | 40 |
| 18 | 49 | 36.5 | — | — | 8 | 1 | 0.5 | Ga: 5 | 85 | 20 |
| 19 | 45 | 37.3 | — | — | 12.2 | 5 | — | Ge: 0.5 | 70 | 10 |
| 20 | 43 | 41 | 14 | — | — | — | 2 | — | 50 | −30 |

| Example No. | Crystal Structure Parent Phase | M Phase | Magnetic Properties Parent Phase | M Phase | ΔI(2) (emu/g) | Electric Resistance Ratio $\rho_M/\rho_P$(3) |
|---|---|---|---|---|---|---|
| 1 | $L2_1$(4) | 10M(5) | Ferromagnetic | Ferrimagnetic | 60 | 2.8 |
| 2 | $L2_1$(4) | 4O(5) | Ferromagnetic | Ferrimagnetic | 62 | 3 |
| 3 | $L2_1$(4) | 4O(5) | Ferromagnetic | Paramagnetic or Antiferromagnetic | 80 | 3.5 |
| 4 | $L2_1$(4) | 4O(5) | Ferromagnetic | Paramagnetic or Antiferromagnetic | 85 | 4.2 |
| 5 | $L2_1$(4) | 4O(5) + 2M(5) | Ferromagnetic | Paramagnetic or Antiferromagnetic | 85 | 4.2 |
| 6 | $L2_1$(4) | 4O(5) | Ferromagnetic | Ferrimagnetic | 60 | 4 |
| 7 | $L2_1$(4) | 4O(5) | Ferromagnetic | Ferrimagnetic | 65 | 3.8 |
| 8 | $L2_1$(4) | 2M(5) | Ferromagnetic | Ferrimagnetic | 70 | 4 |
| 9 | $L2_1$(4) | 2M(5) | Ferromagnetic | Paramagnetic or Antiferromagnetic | 95 | 5.2 |
| 10 | $L2_1$(4) | 2M(5) | Ferromagnetic | Paramagnetic or Antiferromagnetic | 90 | 5.5 |
| 11 | $L2_1$(4) | 4O(5) | Ferromagnetic | Ferrimagnetic | 75 | 3 |
| 12 | $L2_1$(4) | 4O(5) | Ferromagnetic | Ferrimagnetic | 65 | 2.5 |
| 13 | $L2_1$(4) | 4O(5) | Ferromagnetic | Paramagnetic or Antiferromagnetic | 85 | 3.5 |
| 14 | $L2_1$(4) | 4O(5) | Ferromagnetic | Paramagnetic or Antiferromagnetic | 80 | 3 |

TABLE 1-continued

| | | | | | | |
|---|---|---|---|---|---|---|
| 15 | $L2_1$[4] | 4O[5] | Ferromagnetic | Ferrimagnetic | 65 | 2.8 |
| 16 | $L2_1$[4] | 4O[5] + 10M[5] | Ferromagnetic | Paramagnetic or Antiferromagnetic | 85 | 3.5 |
| 17 | $L2_1$[4] | 4O[5] | Ferromagnetic | Ferrimagnetic | 60 | 3 |
| 18 | $L2_1$[4] | 4O[5] + 6M[5] | Ferromagnetic | Ferrimagnetic | 65 | 3 |
| 19 | $L2_1$[4] | 4O[5] | Ferromagnetic | Paramagnetic or antiferromagnetic | 85 | 4 |
| 20 | $L2_1$[4] | 4O[5] | Ferromagnetic | Ferrimagnetic | 70 | — |

| | Alloy Composition (atomic %)[1] | | | | | | | | | |
|---|---|---|---|---|---|---|---|---|---|---|
| Comp. Ex. No. | Ni | Mn | In | Sn | Sb | Co | Fe | Other Elements | Tc (° C.) | Ms (° C.) |
| 1 | 47 | 45.5 | 4.5 | — | — | — | 3 | — | —[6] | 480 |
| 2 | 50 | 25 | 2 | 23 | — | — | — | — | —[6] | —[7] |
| 3 | 49 | 28 | 1 | — | 22 | — | — | — | —[6] | —[7] |
| 4 | 47.2 | 46 | — | 4.8 | — | 2 | — | — | —[6] | 420 |

| | Crystal Structure | | Magnetic Properties | | | Electric Resistance |
|---|---|---|---|---|---|---|
| Comp. Ex. No. | Parent Phase | M Phase | Parent Phase | M Phase | ΔI[2] (emu/g) | Ratio $\rho_M/\rho_P$[3] |
| 1 | $L2_1$[4] | 2M[5] | Paramagnetic | Paramagnetic or Antiferromagnetic | 0 | 1.2 |
| 2 | $L2_1$[4] | — | Paramagnetic | — | — | — |
| 3 | $L2_1$[4] | — | Paramagnetic | — | — | — |
| 4 | $L2_1$[4] | 2M[5] | Paramagnetic | Paramagnetic or Antiferromagnetic | 0 | 1.2 |

Note:

[1]Containing inevitable impurities.

[2]ΔI represents the difference in magnetization between a parent phase (measured at Ms) and an M phase (measured at Mf) when cooled from the parent phase temperature to the M phase temperature in a magnetic field of 20 kOe.

[3]$\rho_M$ and $\rho_P$ respectively represent the electric resistance (measured immediately under Mf) of the M phase, and the electric resistance (measured immediately above Ms) of the parent phase without a magnetic field.

[4]$L2_1$ represents a Heusler structure.

[5]2M represents a two-layer stacking structure, and 6M, 10M and 4O represent long-period stacking structures.

[6]There was no Tc because the parent phase was paramagnetic.

[7]No transformation.

As is clear from Table 1, each alloy of Examples 1-20 had a ferromagnetic parent phase having a Heusler structure, and a paramagnetic, antiferromagnetic or ferrimagnetic M phase having a stacking structure (any one of 2M, 6M, 10M and 4O). Ms existed in a practical temperature range from −150° C. to +100° C. even without a magnetic field. The difference between Tc and Ms was 40° C. or more, indicating that a ferromagnetic parent phase existed in a wide temperature range. Further, when a magnetic field of 20 kOe was applied, the magnetization difference between the parent phase (at Ms) and the martensite phase (at Mf) was 60 emu/g or more. It is clear that the alloys of Examples 1-19 having $\rho_M/\rho_P$ of 2.5 or more suffered drastic increase in electric resistance in the martensitic transformation from the ferromagnetic parent phase to the paramagnetic, antiferromagnetic or ferrimagnetic M phase.

Because the amount of at least one metal selected from the group consisting of In, Sn and Sb in total was less than 5 atomic % in Comparative Examples 1 and 4 and more than 18 atomic % in Comparative Examples 2 and 3, their parent phases were paramagnetic. Also, because Comparative Examples 1 and 4 had Ms much higher than a practical temperature range, the magnetization difference was 0 emu/g in a magnetic field of 20 kOe. Because the paramagnetic parent phase was transformed to the paramagnetic or antiferromagnetic M phase in Comparative Examples 1 and 4, the $\rho_M/\rho_P$ ratio was 1.2, indicating an extremely small electric resistance change. There was no martensitic transformation in Comparative Examples 2 and 3. It is thus clear that when the amount of at least one metal selected from the group consisting of In, Sn and Sb in total is less than 5 atomic % or more than 18 atomic %, ferromagnetic shape memory alloys having excellent magnetic properties cannot be obtained.

Figure 2:
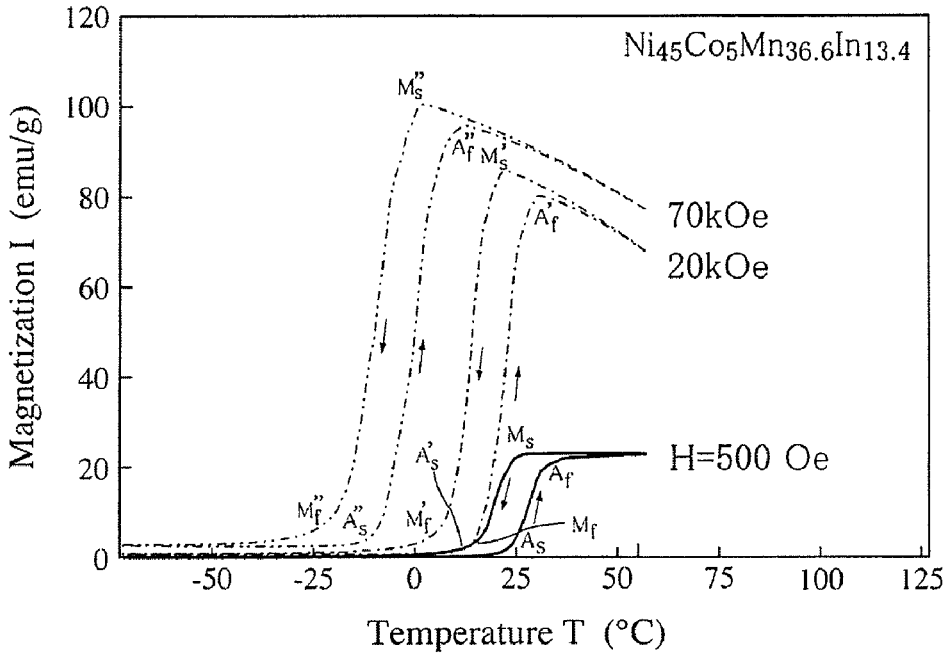
FIG. 2 is a graph showing the dependency of martensitic transformation temperatures on a magnetic field in the ferromagnetic shape memory alloy of Example 4.

The sample of Example 4 was cooled and heated between −40° C. and +55° C. in each magnetic field of 500 Oe (39.8 kA/m), 20 kOe (1,592 kA/m) and 70 kOe (5,570 kA/m), to examine the dependency of Ms on a magnetic field by SQUID. The results are shown in FIG. 2. It is clear from FIG. 2 that Ms decreased by 7° C. when the magnetic field intensity was elevated from 500 Oe to 20 kOe, and decreased by 25° C. when it was elevated to 70 kOe. This verifies that the application of a magnetic field changes the Ms. It is also clear from FIG. 2 that martensitic transformation and martensitic reverse transformation occur in a practical temperature range, in any magnetic field of 500 Oe, 20 kOe and 70 kOe.

Figure 3:
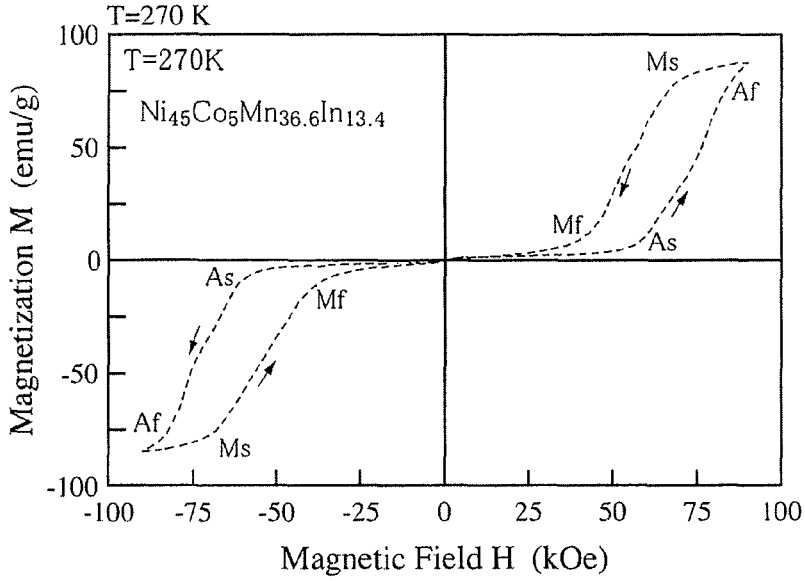
FIG. 3 is a graph showing the magnetization curve of the ferromagnetic shape memory alloy of Example 4, which indicates a magnetic field-induced transformation.

A magnetic field of 0-90 kOe (0-7,162 kA/m) was applied perpendicularly to both surfaces of the sample of Example 4 at a temperature of 270 K (−3° C.), to examine the dependency of a martensitic reverse transformation on a magnetic field by SQUID. The results are shown in FIG. 3. When a magnetic field was applied and then removed at a temperature lower than Mf, the M phase was reverse-transformed to a parent phase and then recovered.

Figure 4:
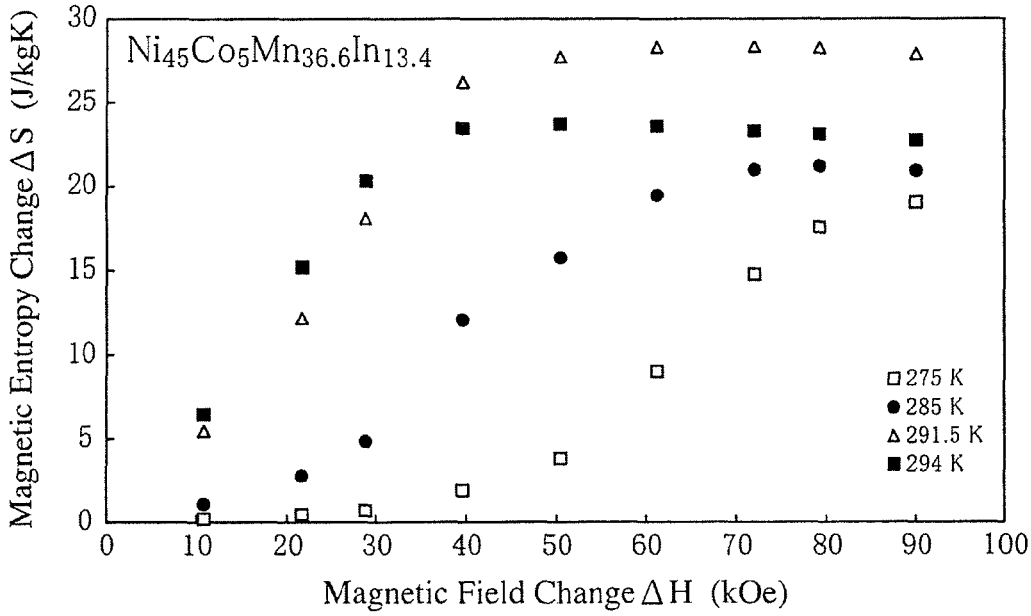
FIG. 4 is a graph showing the dependency of magnetic entropy on a magnetic field change in the ferromagnetic shape memory alloy of Example 4.

The following formula (I):

$$\Delta S = \int_0^{\Delta H} \left(\frac{dI}{dT}\right)_H dH, \quad (1)$$

wherein ΔS represents a magnetic entropy change, H represents a magnetic field, I represents the intensity of magnetization, and T represents a temperature (K), was obtained in a magnetization curve determined by measuring the sample of Example 4 at temperatures of 275 K, 285 K, 291.5 K and 294 K, respectively. Determined from this formula was a magnetic entropy change ΔS relative to a magnetic field change ΔH of 0-90 kOe (0-7,162 kA/m) at each temperature. The results are shown in FIG. 4. As is clear from FIG. 4, the change of a magnetic entropy by the change of a magnetic field from 0 kOe to 90 kOe was 20 J/kgK or more at each temperature. Particularly at 18.5° C., the change of magnetic entropy was as large as 27.5 J/kgK when the magnetic field changed from 0 kOe to 50 kOe (from 0 kA/m to 3,979 kA/m).

Example 21

(1) Production of Sample

A sample of 3 mm×3 mm×3 mm was cut out of an ingot obtained by high-frequency-melting and rapidly cooling an alloy having the same composition as in Example 5. The sample was annealed to have a single crystal, subjected to a solution treatment at 900° C. for 3 days, and then charged into water for rapidly cooling. The sample had Ms of 50° C. and Tc of 104° C. without a magnetic field.

(2) Shape Memory Test

Figure 5:
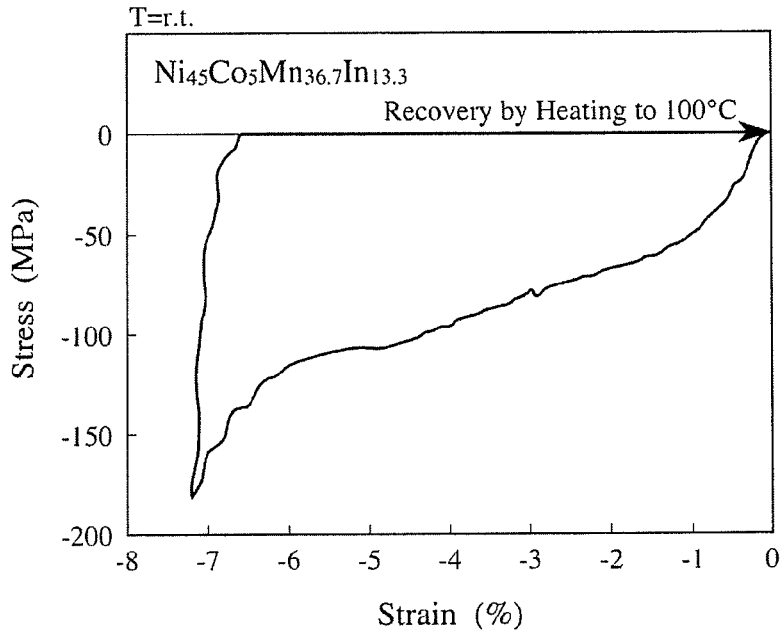
FIG. 5 is a graph showing a stress-strain curve of the ferromagnetic shape memory alloy of Example 21.

Using a compression test machine, compression stress was applied to the sample to a strain of 7.2% at room temperature. The resultant stress-strain curve is shown in FIG. 5. When the compressed sample was heated to 100° C., 100-% shape recovery occurred.

Example 22

(1) Production of Sample

A single crystal sample having Ms of 13° C. and Tc of 106° C. without a magnetic field was produced in the same manner as in Example 21, except for using an alloy having the same composition as in Example 3.

(2) Superelasticity Test

Figure 6:
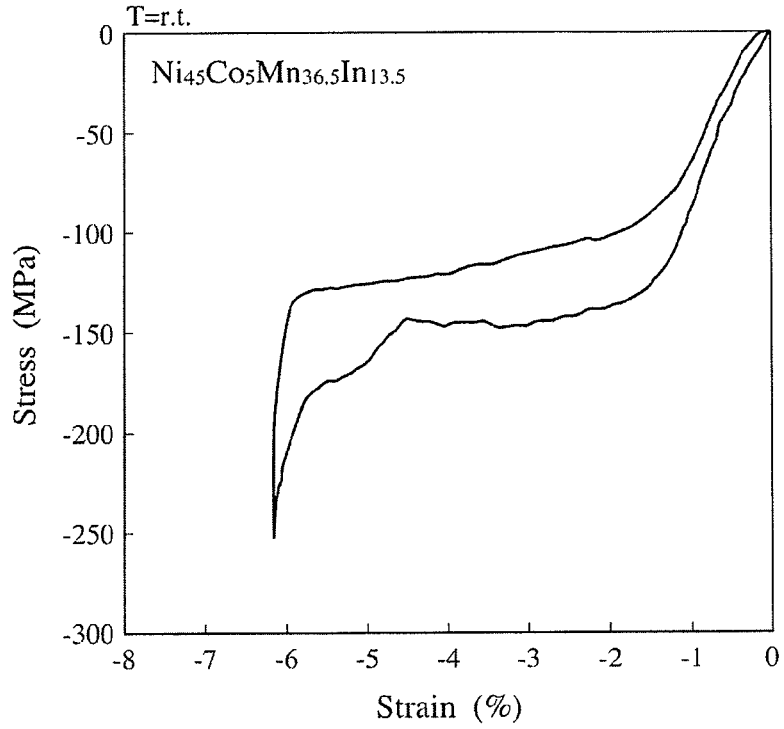
FIG. 6 is a graph showing a stress-strain curve of the ferromagnetic shape memory alloy of Example 22.

Using a compression test machine, compression stress was applied to the sample to a strain of 6.2% at room temperature. The resultant stress-strain curve is shown in FIG. 6. A shape recovery ratio determined from this stress-strain curve was 99%.

Example 23

(1) Production of Sample

An alloy having the same composition as in Example 5 was high-frequency-melted and rapidly cooled to form an ingot, of which a sample of 1.5 mm×1.5 mm×2 mm was cut out. The sample was treated to have a single crystal as in Example 21. The resultant sample had Ms of 50° C. and Tc of 104° C. without a magnetic field.

(2) Measurement of Magnetostriction

Figure 7:
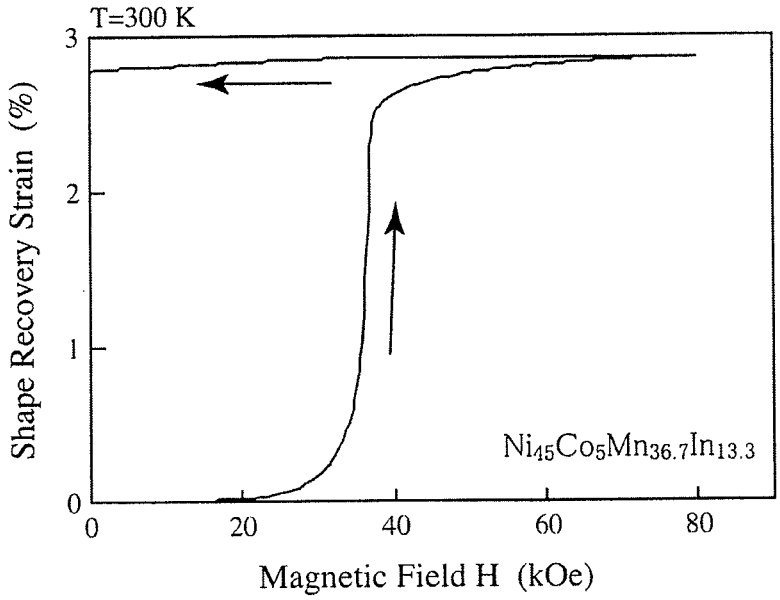
FIG. 7 is a graph showing a magnetic field-induced shape recovery strain in the ferromagnetic shape memory alloy of Example 23.

With a 3-% compression strain added to the sample, a magnetic field was applied to the sample at room temperature, to measure its magnetostriction by a three-terminal capacitance method. The resultant strain-magnetic field curve is shown in FIG. 7. Shape change due to martensitic reverse transformation occurred when the applied magnetic field neared 30 kOe (2,387 kA/m), and reached 2.8% at 80 kOe (6,366 kA/m).

Figure 8:
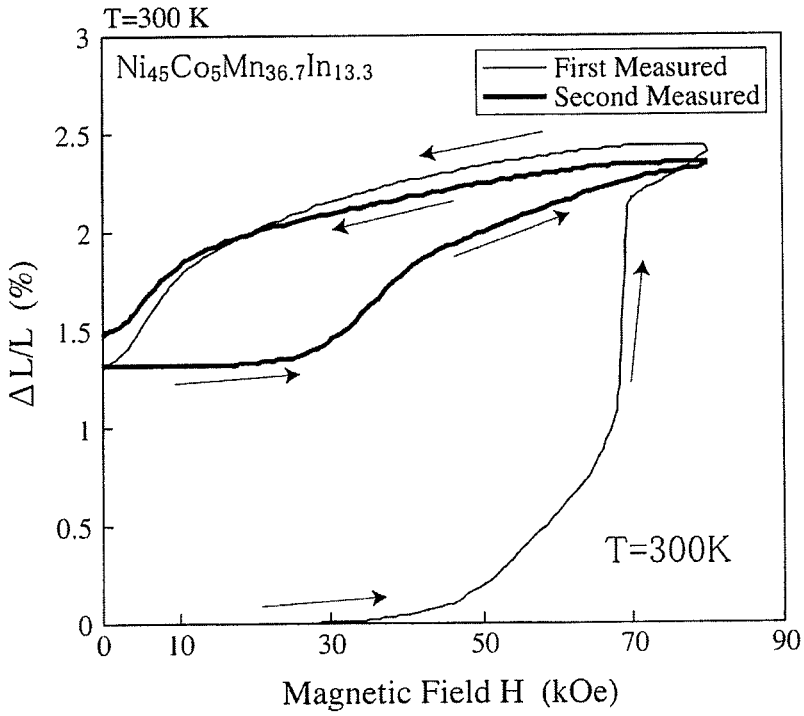

With a 4.5-% compression strain added to the same sample, a magnetic field was adapted to the same at room temperature, to measure its magnetostriction by a three-terminal capacitance method. The resultant strain (ΔL/L)-magnetic field curve is shown in FIG. 8. Shape change occurred when the applied magnetic field neared 40 kOe (3,183 kA/m), and reached 2.5% at 80 kOe (6,366 kA/m). By removing the magnetic field, 1.1-% reversible shape change occurred. In the second measurement, 1-% reversible shape change occurred by the application and removal of a magnetic field. It was thus verified that this sample had a two-way shape memory effect.

Example 24

(1) Production of Sample

A sample of 1 mm×1 mm×10 mm made of an alloy having the same composition ($Ni_{45}Co_5Mn_{36.7}In_{13.3}$) as in Example 5 was treated to have a single crystal as in Example 21, and then subjected to an aging treatment at 400° C. for 1 hour.

(2) Electric Resistance Test

Using an electric resistance meter, the electric resistance change due to the temperature change was measured without a magnetic field by a four-terminal method at a heating/cooling speed of 2° C./minute. The results are shown in FIG. 9. The electric resistance drastically increased by the transformation from the parent phase to the M phase.

With the magnetic field changed from 0 kOe to 80 kOe (6,366 kA/m), the electric resistance change was measured at temperatures of −173° C., −73° C., −33° C. and +27° C., respectively, by a four-terminal method. The results are shown in FIG. 10. The transformation temperature of this sample without a magnetic field were 4° C. in Ms, −22° C. in Mf, 0° C. in As, and 16° C. in Af. In a case where it was completely composed only of a parent phase (T=27° C.), its electric resistance did not change even when a magnetic field was applied. On the other hand, in a case where it was completely composed only of a martensite phase (T<−22° C.), the application of a magnetic field induced reverse transformation from the martensite phase to the parent phase, resulting in decrease in electric resistance, and the removal of the magnetic field caused reversible change to the parent state. Particularly when measured at −33° C., the application and removal of a magnetic field provided a giant magnetoresistance effect, by which the electric resistance changes reversibly.

Example 25

(1) Production of Sample

An alloy having the same composition ($Ni_{41}Co_5Mn_{43}In_{11}$) as in Example 14 was high-frequency-melted and rapidly cooled to form an ingot, of which a sample of 1 mm×1 mm×10 mm was cut out. The sample was subjected to a solution treatment at 900° C. for 20 hours and then air-cooled.

(2) Electric Resistance Test

Using an electric resistance meter, the electric resistance change due to the temperature change was measured without a magnetic field by a four-terminal method at a heating/cooling speed of 2° C./minute. The results are shown in FIG. 11. The electric resistance drastically increased by the transformation from the parent phase to the M phase.

EFFECT OF THE INVENTION

The ferromagnetic shape memory alloy of the present invention having excellent shape memory characteristics and magnetic change characteristics in a practical temperature provides a magnetic-driving device, a thermomagnetic-driving device, a heat-range generating/absorbing device (particularly magnetic freezer), stress-magnetism device, stress-resistance device, and a magnetism-resistance device having high response speed and energy efficiency in a practical temperature range.

What is claimed is:

1. A ferromagnetic shape memory alloy consisting of 25-50 atomic % of Mn, 5-18 atomic % in total of at least one metal selected from the group consisting of In, Sn and Sb, and 0.1-15 atomic % of Co and/or Fe, the balance being Ni and inevitable impurities.

2. The ferromagnetic shape memory alloy according to claim 1, wherein it contains more than 40 atomic % of Ni.

3. The ferromagnetic shape memory alloy according to claim 1, wherein its parent phase is ferromagnetic, and its martensite phase is paramagnetic, antiferromagnetic or ferrimagnetic.

4. The ferromagnetic shape memory alloy according to claim 3, wherein said martensite phase has a long-period stacking structure.

5. The ferromagnetic shape memory alloy according to claim 3, wherein the difference is 50 emu/g or more between magnetization measured at a martensitic transformation-starting temperature and magnetization measured at a martensitic transformation-finishing temperature, and between magnetization measured at a martensitic reverse transformation-starting temperature and magnetization measured at a martensitic reverse transformation-finishing temperature, when a magnetic field of 20 kOe or more is applied.

6. The ferromagnetic shape memory alloy according to claim 3, wherein a $\rho_M/\rho_p$ ratio of the electric resistance $\rho_M$ of the martensite phase to the electric resistance $\rho_p$ of the parent phase is 2 or more.

7. A magnetic-driving device comprising the ferromagnetic shape memory alloy recited in claim 1, which utilizes shape recovery and/or magnetic change caused by martensitic reverse transformation to a ferromagnetic parent phase induced by applying a magnetic field to said ferromagnetic shape memory alloy in a state of a paramagnetic, antiferromagnetic or ferrimagnetic martensite phase.

8. The magnetic-driving device according to claim 7, which utilizes shape change and/or magnetic change caused by a transformation to said martensite phase induced by removing a magnetic field from said ferromagnetic shape memory alloy in a state of said parent phase generated by a magnetic-field-induced reverse transformation.

9. The magnetic-driving device according to claim 8, which utilizes stress generated by said shape recovery and/or said shape change.

10. A thermomagnetic-driving device comprising a temperature-sensitive magnetic body comprising the ferromagnetic shape memory alloy recited in claim 1, which utilizes (a) magnetic change caused by a martensitic reverse transformation to a ferromagnetic parent phase induced by heating said ferromagnetic shape memory alloy in a state of a paramagnetic, antiferromagnetic or ferrimagnetic martensite phase, and/or (b) magnetic change caused by a transformation to said martensite phase induced by cooling the ferromagnetic shape memory alloy in a state of said parent phase.

11. A magnetic freezer composed of the ferromagnetic shape memory alloy recited in claim 1, which utilizes heat absorption occurring in a martensitic reverse transformation to a ferromagnetic parent phase induced by applying a magnetic field to said ferromagnetic shape memory alloy in a state of a paramagnetic, antiferromagnetic or ferrimagnetic martensite phase.

12. A heat-generating/absorbing device comprising the ferromagnetic shape memory alloy recited in claim 1, which utilizes (a) heat generation occurring in said ferromagnetic shape memory alloy in a state of a ferromagnetic parent phase by a martensitic transformation, and (b) heat absorption occurring in said ferromagnetic shape memory alloy in a state of a paramagnetic, antiferromagnetic or ferrimagnetic martensite phase by a martensitic reverse transformation.

13. The heat-generating/absorbing device according to claim 12, wherein (a) said martensitic transformation is induced by applying stress to the ferromagnetic shape memory alloy in a state of said parent phase, or by removing a magnetic field from the ferromagnetic shape memory alloy in a state of said parent phase generated by a magnetic-field-induced reverse transformation; and (b) said martensitic reverse transformation is induced by applying a magnetic field to the ferromagnetic shape memory alloy in a state of said martensite phase, or by removing stress from the ferromagnetic shape memory alloy in a state of a martensite phase generated by a stress-induced transformation.

14. A stress-magnetism device comprising the ferromagnetic shape memory alloy recited in claim 1, which utilizes (a) magnetic change caused by a transformation to a paramagnetic, antiferromagnetic or ferrimagnetic martensite phase induced by applying stress to said ferromagnetic shape memory alloy in a state of a ferromagnetic parent phase, and/or (b) magnetic change caused by a reverse transformation to said parent phase induced by removing stress from the ferromagnetic shape memory alloy in a state of a martensite phase generated by a stress-induced transformation.

15. A stress-resistance device comprising the ferromagnetic shape memory alloy recited in claim 1, which utilizes (a) electric resistance change caused by a transformation to a paramagnetic, antiferromagnetic or ferrimagnetic martensite phase induced by applying stress to said ferromagnetic shape memory alloy in a state of a ferromagnetic parent phase, and/or (b) electric resistance change caused by a reverse transformation to said parent phase induced by removing stress from the ferromagnetic shape memory alloy in a state of a martensite phase generated by a stress-induced transformation.

16. A magnetoresistance device comprising the ferromagnetic shape memory alloy recited in claim 1, which utilizes (a) electric resistance change caused by a martensitic reverse transformation to a ferromagnetic parent phase induced by applying a magnetic field to said ferromagnetic shape memory alloy in a state of a paramagnetic, antiferromagnetic or ferrimagnetic martensite phase, and/or (b) electric resistance change caused by a transformation to said martensite phase induced by removing a magnetic field from the ferromagnetic shape memory alloy in a state of a parent phase generated by a magnetic-field-induced reverse transformation.

17. A ferromagnetic shape memory alloy comprising 25-50 atomic % of Mn, 5-18 atomic % in total of at least one metal selected from the group consisting of In, Sn and Sb, 0.1-15 atomic % of Co and/or Fe, 0.1-15 atomic % in total of at least one metal selected from the group consisting of Ti, Pd, Pt, Al, Ga, Si, Ge, Pb and Bi, and more than 40 atomic % of Ni, the balance being inevitable impurities.

18. A ferromagnetic shape memory alloy comprising 25-50 atomic % of Mn, 5-18 atomic % in total of at least one metal selected from the group consisting of In, Sn and Sb, 0.1-15 atomic % of Co and/or Fe, and 0.1-15 atomic % in total of at least one metal selected from the group consisting of Pd, Pt, Pb and Bi, the balance being Ni and inevitable impurities.

19. The ferromagnetic shape memory alloy according to claim 18, wherein it contains more than 40 atomic % of Ni.

* * * * *